US006004597A

United States Patent [19]

Coleman et al.

[11] Patent Number: 6,004,597

[45] Date of Patent: Dec. 21, 1999

[54] COMBINATION EDIBLE PRODUCT HOLDING DISPENSER AND WRITING ACCESSORY DEVICE

[76] Inventors: Thomas J. Coleman, 19170 Paddock Pl., Abingdon, Va. 24211; William K. Schlotter, IV, 117 Wateredge La., Fredericksburg, Va. 22406; Princess Ann Coleman, 19170 Paddock Pl., Abingdon, Va. 24211; Ann M. Schlotter, 117 Wateredge La., Fredericksburg, Va. 22406

[21] Appl. No.: 08/967,609

[22] Filed: Nov. 10, 1997

[51] Int. Cl.[6] ..... B65D 83/04; B65D 81/36; B43K 29/20

[52] U.S. Cl. ..... 426/112; 426/104; 426/115; 426/132; 401/52; 401/195; 206/537

[58] Field of Search ..... 426/104, 132, 426/112, 115; 401/52, 195; 206/542, 537, 214, 224

[56] References Cited

U.S. PATENT DOCUMENTS

| | | | |
|---|---|---|---|
| D. 356,113 | 3/1995 | Maggio | 401/195 |
| 1,546,715 | 7/1925 | Calvento | 401/195 |
| 1,950,960 | 3/1934 | Wisser | 401/195 |
| 2,060,406 | 11/1936 | Tiede | 206/537 |
| 2,266,942 | 12/1941 | Wallace | 401/195 |
| 2,354,402 | 7/1944 | Petruccione et al. | 401/195 |
| 2,497,826 | 2/1950 | Sullivan | 401/195 |
| 2,529,661 | 11/1950 | Millstein | 426/104 |
| 2,590,476 | 3/1952 | Stough | 426/104 |
| 2,718,299 | 9/1955 | Atwater | 206/537 |
| 2,772,772 | 12/1956 | Taylor | 206/537 |
| 2,975,547 | 3/1961 | Greve | 426/132 |
| 3,138,249 | 6/1964 | Paulini | 426/104 |
| 3,390,460 | 7/1968 | Brown et al. | 401/195 |
| 3,448,541 | 6/1969 | Barlow | 401/195 |
| 3,639,069 | 2/1972 | Gordon | 401/195 |
| 3,968,902 | 7/1976 | Bachmann | 206/537 |
| 4,162,754 | 7/1979 | Fleming | 401/195 |
| 4,336,882 | 6/1982 | Sakwa | 401/195 |
| 4,530,503 | 7/1985 | Rice | 401/195 |
| 4,580,919 | 4/1986 | Ambasz | 401/209 |
| 4,728,212 | 3/1988 | Spector | 401/195 |
| 4,755,074 | 7/1988 | Roberts | 401/52 |
| 5,007,756 | 4/1991 | Wey | 401/52 |
| 5,009,535 | 4/1991 | Oilar | 401/195 |
| 5,158,384 | 10/1992 | Radmilovic et al. | 401/52 |

FOREIGN PATENT DOCUMENTS

| | | | |
|---|---|---|---|
| 770358 | 6/1933 | France | 401/195 |
| 1067735 | 12/1952 | France | 206/537 |
| 1252896 | 2/1960 | France | 401/195 |
| 2525444 | 10/1983 | France | 401/195 |
| 822217 | 11/1951 | Germany | 401/52 |
| 2642476 | 3/1978 | Germany | 401/52 |
| 437049 | 11/1967 | Switzerland | 401/195 |
| 405081 | 2/1934 | United Kingdom | 401/52 |

*Primary Examiner*—Steven Weinstein
*Attorney, Agent, or Firm*—Melvin L. Crane

[57] ABSTRACT

A novelty candy/pen holding device designed to provide fun and entertainment to children of all ages. The device includes a main housing comprising a hollow stretchable and bendable plastic tube or any suitable material with a hollow plastic upper housing connected with the main housing. The plastic upper housing has an aperture at the top to hold a ball point pen ink cartridge or any other writing accessory. The lower end of the main housing has a threaded end cap whereupon a threaded candy/gum reservoir is threaded to the main housing. To dispense the candy/gum from the reservoir, remove the ball point pen ink cartridge from the aperture of the hollow upper housing and tilt the reservoir so the candy/gum travels through the hollow main housing into the hollow upper housing and out the aperture at the top of the hollow upper housing into a child's hand. Replace the ball point pen ink cartridge to keep the candy/gum inside of the container. This device is designed not only as a candy dispenser and as a toy which stretches and bends into different positions, but also as a fun writing tool. The hollow upper housing can be designed as a fire hose nozzle, animal heads, or character heads or any other configuration.

6 Claims, 2 Drawing Sheets

COMBINATION EDIBLE PRODUCT HOLDING DISPENSER AND WRITING ACCESSORY DEVICE

This invention is directed to a combination edible product holding dispenser and a writing accessory device.

BACKGROUND OF THE INVENTION

Heretofore various devices have been made which have elongated, flexible, bendable hollow tube-like parts. Some of these have been set forth in U.S. patents. U.S. Pat. No. 3,134,453 sets forth an amusing device having an elongated part made of spring steel covered by a protective covering. The elongated part can be bent into different shapes. U.S. Pat. No. 4,034,499 has an elongated hollow bendable tubular member which is used in a musical device for making different sounds. U.S. Pat. No. 4,495,550 sets forth a flashlight with a flexible bellows which can be bent in different directions for directing the light to different places. U.S. Pat. No. 4,579,538 is directed to a construction toy which utilizes bendable hollow members. U.S. Pat. No. 3,615,596 sets forth a combination lollipop-writing accessory with a rigid body portion.

OBJECTS AND ADVANTAGES

It is therefore an object of the invention to provide a combination candy holder-dispenser writing accessory in which the body of the device can be bent in different shapes for amusement of a user.

Another object is to provide a device which can be amusing to adults as well as children.

Still another object is to provide an amusing device which is provided with different characters or representations of different devices.

Other objects and advantages will become obvious to those skilled in the art from a review of the specification that other forms may be made within the scope of the invention.

DETAILED DESCRIPTION

Figure 1:
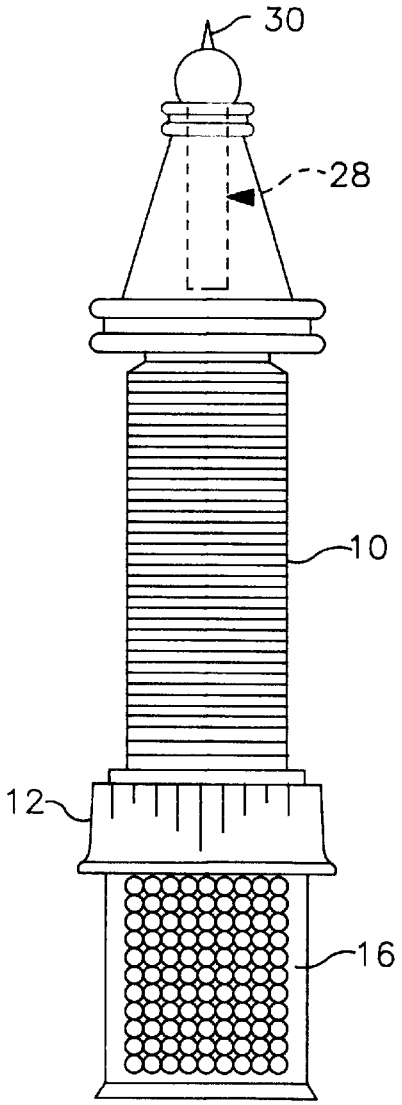
FIG. 1 illustrates a side view of the device in an upright position.
Figure 2:
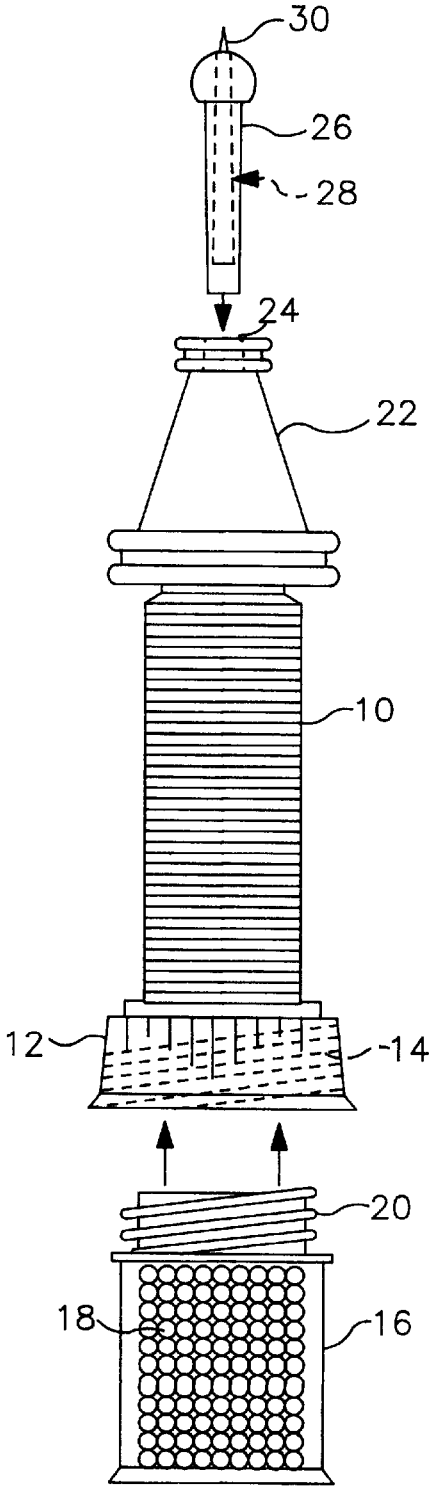
FIG. 2 illustrates the device shown in FIG. 1 in an exploded view.
Figure 3:
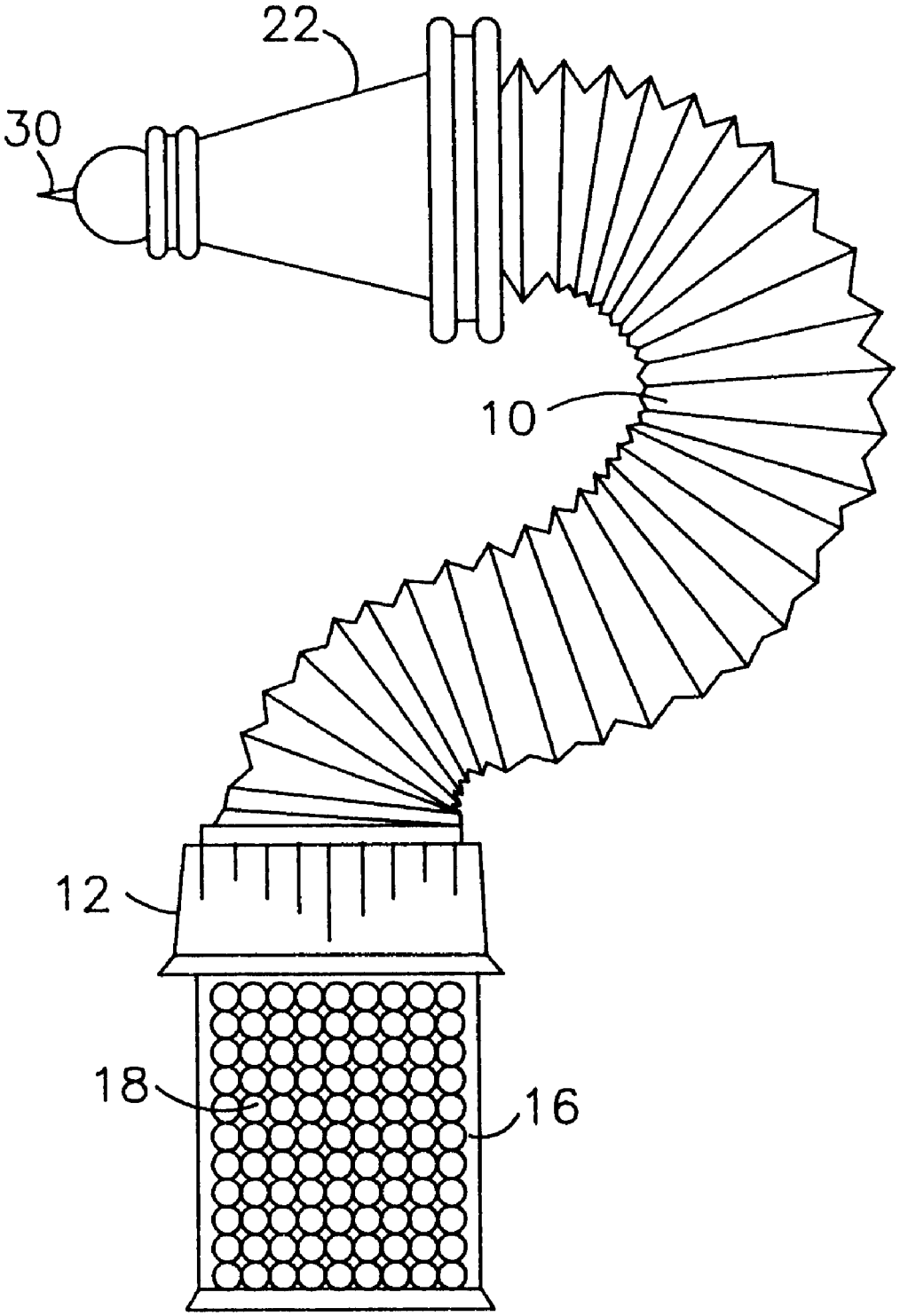
FIG. 3 illustrates the device with the body bent in a different shape and illustrating candy or gum in a reservoir.

Now referring to the drawings wherein like parts are represented by like reference characters, there is shown in FIG. 1 a side view of the device in an upright position. As shown, the device includes an elongated, hollow main body 10 made of a corrugated bellows-like tube which is made of a flexible, semi-rigid material such as plastic or the like which can be bent into different shapes such as shown in FIG. 3. The housing is provided with a rigid, lower housing 12 which is cylindrical in shape and provided with a threaded inner surface 14. Attached to the bottom housing is a reservoir 16 in which candy, gum or any other substance 18 may be enclosed. The upper end of the reservoir is provided with threads 20 on an outer end surface which matches the threads on the inner surface of the lower housing in order to secure the reservoir 16 to the lower housing. The flexible hollow body 10 is provided with a hollow, rigid upper housing 22. The upper end of the upper housing is provided with an aperture 24 which is shown by the dotted lines. An ink pen 26 with an ink cartridge 28 or any other suitable writing accessory is inserted into the aperture 24 and held there for use as a writing instrument. As shown, the pen is provided with a ball point 30 for feeding the ink from the cartridge when writing.

For use of the device, candy, gum or any such pleasurable small pieces of a product 18 are placed in the reservoir 16 and the reservoir is secured to the lower housing. The writing accessory is secured within the aperture in the upper housing. The device is now ready for use. The elongated housing can be bent into some shape if desired as a play toy. The writing instrument can be used for any purpose of writing, drawing, etc. If the person desires a piece of the product contained in the reservoir, the writing accessory is removed from the upper housing and the housing and reservoir are tilted so that at least one piece of the product is dispensed through the aperture in the upper housing. Once one or more pieces of the product have been dispensed, the writing accessory is inserted back into the aperture 24 and no more of the product can be dispensed. Any time that a piece of product is desired, the writing accessory is removed and the desired number of pieces of the product is dispensed and then the writing instrument is replaced in the aperture.

All parts of the housing and reservoir can be made of suitable rigid or flexible plastic as required for carrying out the invention. The housing, etc. must be made with smooth surfaces so that users will not injure themselves on the device. It is obvious that the device can be used for the pleasure of adults and children of most any age as a toy and/or as a writing instrument with a supply of a product in the reservoir for one's pleasure.

For added pleasure, the body could be provided with a picture or different colors so that different designs would be made when the housing is bent. Further, the upper housing could be designed in a configuration such as a fire hose nozzle, animal heads, or any character heads or any other desired configuration so long as an aperture is provided for receipt of the writing accessory.

The foregoing relates to preferred exemplary embodiments of the invention, it being understood that other variants and embodiments thereof are possible within the spirit and scope of the invention, the latter being defined by the appended claims.

We claim:

1. A novelty edible product/writing accessory device which comprises a hollow open-ended main housing having an elongated body of flexible material which is capable of being bent into different shapes, said main housing having both a hollow, rigid lower end housing and a hollow, rigid upper end housing, both fixedly secured to said main housing, a reservoir having a closed bottom end and a rigid open upper end, said rigid open upper end of said reservoir is adapted to be secured to the rigid lower end housing of said main housing, said reservoir including small pieces of edible product therein, said rigid upper end housing having an aperture therein, and a writing accessory having a writing end and a non-writing end, said non-writing end of said writing accessory is adapted to be removably secured within said aperture of said upper end housing so that the writing end of said writing accessory extends out of said rigid upper end housing so that the writing end of said writing accessory extends out of said rigid upper end housing so that the combination of writing accessory and main housing can be used as a writing instrument, each of said pieces of edible product being of a size sufficient to pass from said reservoir, through said lower, main and upper housings and said aperture so that upon removal of said writing accessory from said aperture, said main housing and reservoir can be tilted to dispense one or more pieces of edible product through said aperture.

2. A novelty edible product/writing accessory device as claimed in claim 1, wherein said lower end housing of said main housing includes screw threads on an inner surface thereof, and said open upper end of said reservoir includes screw threads thereon that are compatible with said screw threads on the inner surface of said lower end housing of said main housing to allow said open upper end of the reservoir to be secured to said lower end housing of said main housing.

3. A novelty edible product/writing accessory as claimed in claim 1, wherein said edible product is candy and said writing accessory is a ball point pen.

4. A novelty edible product/writing accessory as claim in claim 2, wherein said edible product is candy and said writing accessory is a ball point pen.

5. A novelty edible product/writing accessory as claimed in claim 1, wherein said upper end housing of said main housing is in a form of a character, head, head and body, animal, or person.

6. A novelty edible product/writing accessory as claimed in claim 2, wherein said upper end housing of said main housing is in a form of a character, head, head and body, animal, or person.

* * * * *